US009033601B2

(12) United States Patent
Koike

(10) Patent No.: US 9,033,601 B2
(45) Date of Patent: May 19, 2015

(54) RECORDING DEVICE, CONTROL METHOD OF A RECORDING DEVICE, AND STORAGE MEDIUM

(71) Applicant: Seiko Epson Corporation, Tokyo (JP)

(72) Inventor: Toshiaki Koike, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/780,102

(22) Filed: Feb. 28, 2013

(65) Prior Publication Data

US 2013/0266359 A1 Oct. 10, 2013

(30) Foreign Application Priority Data

Apr. 9, 2012 (JP) ..... 2012-088446

(51) Int. Cl.
*B41J 11/00* (2006.01)
*B41J 11/66* (2006.01)

(52) U.S. Cl.
CPC ..... *B41J 11/663* (2013.01)

(58) Field of Classification Search
CPC ..... B41J 11/703; B41J 11/70; B41J 11/663
USPC ..... 400/621; 235/31 R; 83/33; 399/385
See application file for complete search history.

(56) References Cited

U.S. PATENT DOCUMENTS

| | | | | |
|---|---|---|---|---|
| 3,933,069 | A * | 1/1976 | Tall et al. | 83/210 |
| 3,967,518 | A * | 7/1976 | Edwards | 83/210 |
| 4,216,719 | A * | 8/1980 | Flaceliere et al. | 101/227 |
| 4,982,887 | A * | 1/1991 | Takahashi | 226/24 |
| 8,096,718 | B2 | 1/2012 | Yoshioka | |
| 2005/0036817 | A1 * | 2/2005 | Wilken et al. | 400/582 |

FOREIGN PATENT DOCUMENTS

| | | |
|---|---|---|
| JP | 07-097133 | 4/1995 |
| JP | 07-097134 | 4/1995 |
| JP | 2011-178168 | 9/2011 |

* cited by examiner

*Primary Examiner* — Matthew G Marini

(57) ABSTRACT

The cutting control unit 20*a* of a printer 1 monitors the output value of a notch detection sensor 19 while conveying a recording medium, and calculates a position corresponding to the axis of symmetry of a notch where a cutting unit is to cut based on a starting position and an end position. The starting position is the position of the recording medium at the detection position of the sensor when the sensor output value exceeds a specific threshold. The end position is the position of the recording medium at the detection position when the sensor output value goes below the specific threshold after the starting position is detected.

18 Claims, 5 Drawing Sheets

YJ2
YJ4
80 STEPS
70 STEPS
70 STEPS
T3
T2
T1
401
402
403
R1
R2
X1
X2
J
41

RECORDING DEVICE, CONTROL METHOD OF A RECORDING DEVICE, AND STORAGE MEDIUM

BACKGROUND

1. Technical Field

The present invention relates to a recording device that cuts a recording medium at a specific position, to a control method of the recording device, and to a program for controlling the recording device.

2. Related Art

Recording devices (printers) that continuously produce tickets and other slips of a regular size by recording images and cutting the recording medium (roll paper) at a regular interval are known from the literature. See, for example, Japanese Unexamined Patent Appl. Pub. JP-A-2011-178168.

In order to product slips of a regular size, such recording devices must cut the recording medium at the appropriate position. To do this, some recording devices cut the recording medium at the appropriate position by using a recording medium having position detection marks prerecorded at a constant interval in the conveyance direction, and optically detect these marks when producing tickets to adjust the position of the recording medium based on the detected marks.

Recording media having pre-recorded position detection marks, however, are specialized products, and the availability of specialized recording media having pre-recorded position detection marks for producing tickets is not always assured. There is, therefore, a need for being able to appropriately calculate the cutting position of the recording medium using the shape of the recording medium so that the recording medium can be cut at the appropriate position even when using a recording medium that does not have pre-recorded position detection marks.

SUMMARY

With consideration for the foregoing problem, a recording device according to the present invention uses a characteristic of the shape of the recording medium to appropriately determine the position where the recording medium should be cut.

To achieve the foregoing object, a recording device according to the invention has a conveyance unit that conveys a recording medium through a conveyance path; a recording unit that records on the recording medium; a cutting unit that cuts the recording medium; a sensor that detects the recording medium; and a control unit that controls the conveyance unit, the recording unit, and the cutting unit. The recording medium has notches with a line symmetrical shape to an axis of symmetry intersecting the media conveyance direction at a specific interval. The control unit acquires output values of the sensor while conveying the recording medium with the conveyance unit, sets the time when the sensor output value goes above or goes below a specific threshold as a starting position of the notch, and sets the time when the sensor output value goes below or goes above the specific threshold as an end position of the notch, sets a position corresponding to the axis of symmetry of the notch as a cutting position based on the starting position and end position, and cuts with the cutting unit at this cutting position.

Some recording media for producing tickets have blank tickets connected in series in the conveyance direction with a notch that is shaped line symmetrically to an axis of symmetry crossing the conveyance direction at the joint between one ticket and another ticket. When tickets are produced using such recording media, the recording medium must be cut at the position corresponding to the joint between consecutive tickets, that is, at the position corresponding to the axis of symmetry of the notch formed at the joint.

When the recording medium is conveyed, the output value of the sensor when a notch passes the detection position where the sensor is disposed changes in a specific pattern, first going above (or going below) a specific threshold, then peaking, and then going below (or going above) the specific threshold. As a result, the position of the recording medium at the detection position when the sensor output peaks, that is, the position corresponding to the axis of symmetry of the notch, can be calculated based on the position of the recording medium at the detection position when the sensor output goes above (goes below) the threshold (the starting position), and the position of the recording medium at the detection position when the sensor output goes below (goes above) the threshold (the end position).

The recording device according to the invention therefore acquires sensor output while conveying the recording medium, detects the starting position and the end position of each notch, and based on the starting position and the end position sets the position corresponding to the axis of symmetry of the notch as the cutting position. The recording device can therefore appropriately determine where to cut the recording medium using a characteristic of the shape of the notch instead of optically reading position detection marks, for example.

In another aspect of the invention, the control unit preferably sets a position separated a distance-from-axis from the starting position as the cutting position corresponding to the axis of symmetry of the notch, the distance-from-axis being a distance corresponding to half the distance conveyed by the conveyance unit between the starting position and the end position.

Because the notch is shaped line symmetrically to the axis of symmetry, the waveform of sensor output from when the starting position reaches the detection position until the end position reaches the detection position peaks at the midpoint between the output at the starting position and the output at the end position. The position of the recording medium at this peak is the position corresponding to the axis of symmetry of the notch.

Based thereon, the recording device according to this aspect of the invention sets a position separated a distance-from-axis, which is a distance corresponding to half the distance between the starting position and the end position, from the starting position as the position corresponding to the axis of symmetry of the notch, and can therefore use a characteristic of the shape of the notch to appropriately determine the position where the recording medium should be cut.

In another aspect of the invention, the control unit calculates the distance-from-axis based on the starting position and the end position of one notch, and for the next notch after the one notch, sets a position separated the distance-from-axis calculated for the one notch from the starting position of the next notch as the cutting position corresponding to the axis of symmetry of the next notch.

The position corresponding to the axis of symmetry of the notch is first calculated when the end position of the notch passes the detection position. Therefore, if the position of the recording medium is adjusted using the position corresponding to the calculated axis of symmetry of the notch as the cutting position, the cutting position has already past the detection position when the cutting position is set, a process related to adjusting the difference between the cutting position at the time the cutting position was set and the detection position is required, and processing can become complicated.

However, because the recording device according to the invention uses the distance-from-axis calculated from the starting position and the end position of one notch to calculate the position corresponding to the axis of symmetry of the next notch, the position of the recording medium can be adjusted referenced to the position corresponding to the axis of symmetry of the next notch (the cutting position) reaching the detection position, and complicating the process can be suppressed.

In another aspect of the invention, the control unit determines the cutting position based on the starting position and the end position of the one notch after the one notch has past the sensor and before the next notch passes the sensor when not recording on the recording medium by the recording unit.

The process of recording an image on the recording on the recording medium with the recording unit imposes a heavy load on the CPU, and the CPU is therefore preferably not assigned to other tasks while recording. This is particularly important in a recording device because a low performance CPU is often used to meet demands for small size and low cost.

Because the recording device in this aspect of the invention calculates the distance-from-axis based on the starting position and the end position of one notch after the one notch has past the sensor and before the next notch passes the sensor when not recording on the recording medium by the recording unit, using the CPU to execute the process of calculating the distance-from-axis can be limited while the CPU is assigned to the process of recording on the recording medium, and the need described above can be appropriately met.

A recording device according to another aspect of the invention preferably also has a threshold setting unit that sets the specific threshold based on output of the sensor when the recording medium is not at the detection position of the sensor.

Sensor output can change for various reasons, including aging of the sensor and soiling. This aspect of the invention, however, dynamically sets the specific threshold according to actual sensor output, and can therefore set the specific threshold to an appropriate value based on the actual condition of the sensor.

Another aspect of the invention is a control method of a recording device that has a conveyance unit that conveys a recording medium through a conveyance path, a recording unit that records on the recording medium, a cutting unit that cuts the recording medium, and a sensor that detects the recording medium, wherein the recording medium has notches with a line symmetrical shape to an axis of symmetry intersecting the media conveyance direction at a specific interval, and the control method includes: acquiring output values of the sensor while conveying the recording medium with the conveyance unit; setting the time when the sensor output value goes above or goes below a specific threshold as a starting position of the notch, and setting the time when the sensor output value goes below or goes above the specific threshold as an end position of the notch; setting a position corresponding to the axis of symmetry of the notch as a cutting position based on the starting position and end position; and cutting with the cutting unit at this cutting position.

With the control method according to this aspect of the invention, the recording device monitors sensor output while conveying the recording medium, detects the starting position and the end position of each notch, and based on the starting position and the end position calculates the position corresponding to the axis of symmetry of the notch as the cutting position. The recording device can therefore appropriately determine where to cut the recording medium using a characteristic of the shape of the notch instead of optically reading position detection marks, for example.

Another aspect of the invention is a computer-readable storage medium storing a program that is executed by a control unit that controls parts of a recording device having a conveyance unit that conveys a recording medium through a conveyance path, a recording unit that records on the recording medium, a cutting unit that cuts the recording medium, and a sensor that detects the recording medium. The recording medium has notches with a line symmetrical shape to an axis of symmetry intersecting the media conveyance direction at a specific interval, and the program causes the control unit to: acquire output values of the sensor while conveying the recording medium with the conveyance unit; set the time when the sensor output value goes above or goes below a specific threshold as a starting position of the notch, and set the time when the sensor output value goes below or goes above the specific threshold as an end position of the notch; set a position corresponding to the axis of symmetry of the notch as a cutting position based on the starting position and end position; and cut with the cutting unit at this cutting position.

With the computer-readable storage medium storing this program, the recording device monitors sensor output while conveying the recording medium, detects the starting position and the end position of each notch, and based on the starting position and the end position calculates the position corresponding to the axis of symmetry of the notch as the cutting position. The recording device can therefore appropriately determine where to cut the recording medium using a characteristic of the shape of the notch instead of optically reading position detection marks, for example.

EFFECT OF THE INVENTION

The invention can use a characteristic of the shape of the recording medium to appropriately calculate the position where the recording medium should be cut.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
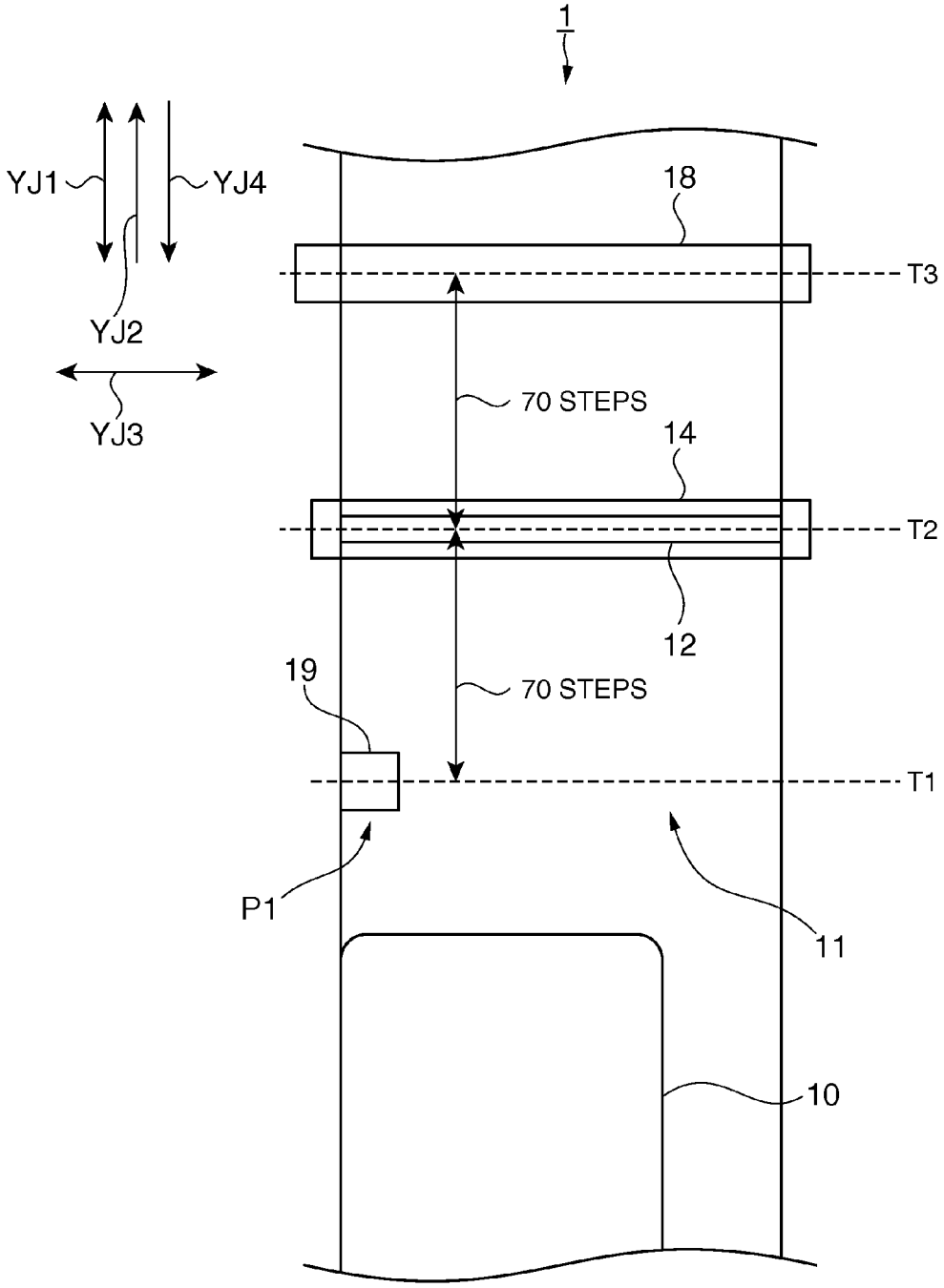
FIG. 1 shows the configuration of a printer according to a preferred embodiment of the invention.

FIG. 1 schematically describes the internal configuration of a printer 1 (recording device) according to this embodiment of the invention.

This printer 1 is a recording device that can produce slips (such as tickets) of a regular size with a specific image recorded thereon by recording images on the recording surface of special paper 10 using a thermal head 12 (recording unit) described below, and cutting the special paper 10 at a suitable position with a cutter mechanism 18 (cutting unit) described below, while conveying the special paper 10 (recording medium) forward YJ2 in the conveyance direction YJ1 through a conveyance path 11. An example of the specific shape of the special paper 10 is described below.

As shown in FIG. 1, the thermal head 12 is disposed to the conveyance path 11. The thermal head 12 is a line thermal head with a plurality of heat elements disposed in the line direction YJ3 (direction crosswise to the conveyance direction), which intersects the conveyance direction YJ1, and records images on the special paper 10 by forming dots on the recording surface of the special paper 10 using the heat elements.

A platen roller 14 (conveyance unit) is disposed at a position opposite the thermal head 12. The platen roller 14 is a platen roller that conveys the special paper 10 through the conveyance path 11, and conveys the special paper 10 in the forward direction YJ2 or in the opposite, reverse direction YJ4, according to rotation of the platen roller 14.

The cutter mechanism 18 is disposed to the conveyance path 11 on the downstream side of the thermal head 12 in the forward direction YJ2. The cutter mechanism 18 is a mechanism that cuts the special paper 10, such as a cutter with a fixed knife and a movable knife, for example.

A notch detection sensor 19 (sensor) is also disposed to the conveyance path 11 on the upstream side of the thermal head 12 in the forward direction YJ2. The notch detection sensor 19 is a transmissive optical sensor used for detecting notches R (described below) formed in the special paper 10. The notch detection sensor 19 is disposed to a detection position P1, a position where the notches R formed in the special paper 10 pass when the special paper 10 is conveyed.

Position T1 in FIG. 1 indicates the position where the notches R in the special paper 10 are detected by the notch detection sensor 19 (the position where the sensor elements are disposed, referred to below as the "detection position"). Position T2 indicates the position where dots are formed on the recording surface of the special paper 10 by the thermal head 12 (the position where the heat elements are disposed, referred to below as the "recording position"). Position T3 indicates the position where the cutter mechanism 18 cuts the special paper 10 (the position where the movable knife and fixed knife intersect, referred to below as the "cutting position").

Figure 2:
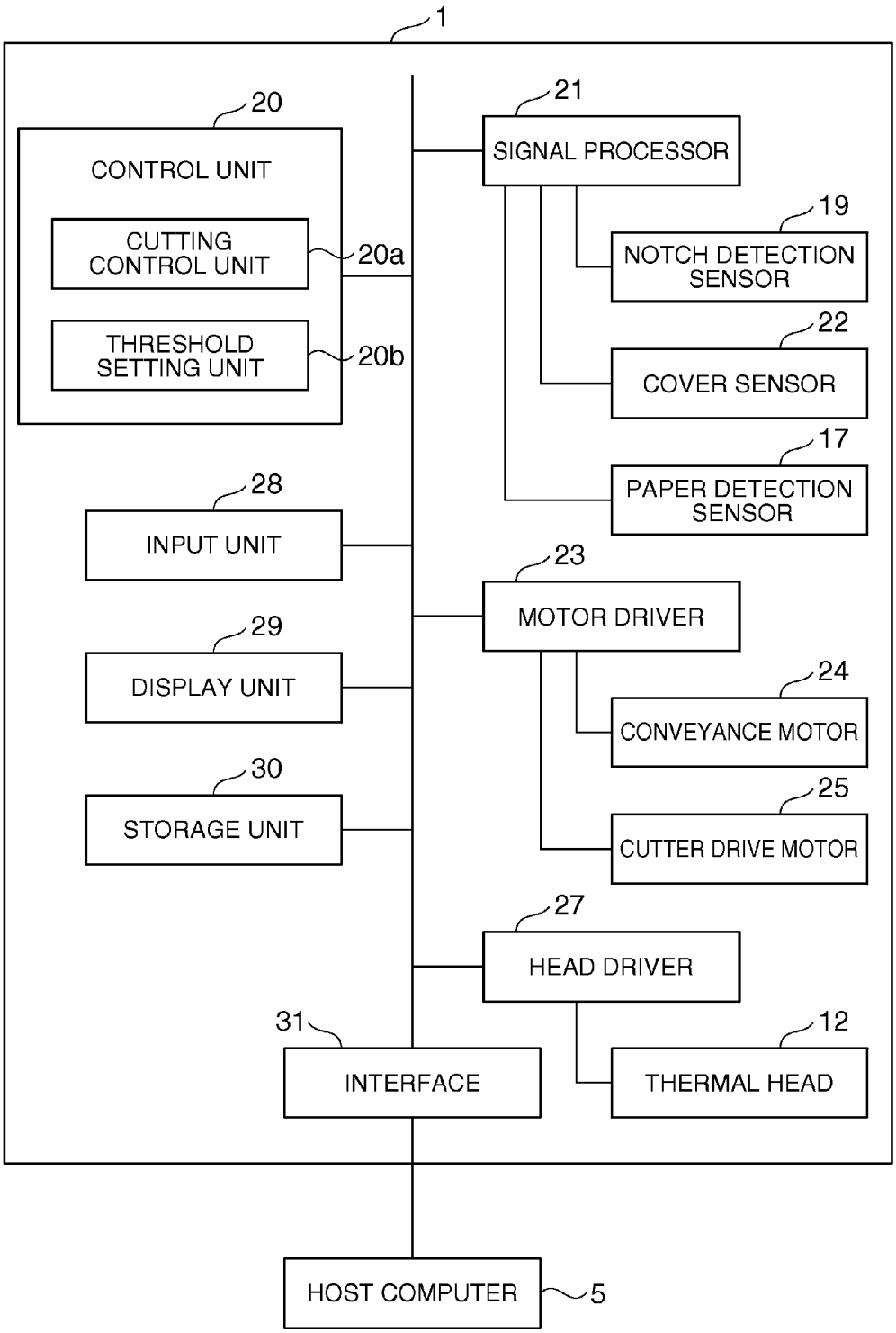
FIG. 2 is a block diagram showing the functional configuration of the printer.

FIG. 2 is a block diagram showing the functional configuration of the printer 1.

The control unit 20 centrally controls other parts of the printer 1, and includes a CPU as a control processor, ROM that nonvolatilely stores programs such as firmware run by the CPU, RAM used as working memory that temporarily stores the program run by the CPU and program data, and other peripheral circuits. The control unit 20 also includes a cutting control unit 20*a* and threshold setting unit 20*b* as function blocks which are further described below.

A signal processor 21 is connected to the control unit 20, and the notch detection sensor 19 described above, a cover sensor 22, and a paper detection sensor 17 are connected to the signal processor 21. The cover sensor 22 is a sensor for detecting if the cover (not shown in the figure) of the printer 1 is open or closed, and more specifically is a sensor switch that turns on when the cover is opened. The paper detection sensor 17 is a sensor for detecting if recording medium, including the special paper 10, is set in the printer 1, and more specifically is a sensor switch that turns on when the recording medium is loaded. A state in which the recording medium is not loaded includes when the recording medium that was loaded runs out.

The signal processor 21 outputs the output values from the notch detection sensor 19, cover sensor 22, and paper detection sensor 17 to the control unit 20 after signal processing such as A/D conversion. The cutting control unit 20*a* of the control unit 20 executes a process related to calculating the cutting position of the special paper 10 based on notch detection sensor 19 output as described below. As described below, the threshold setting unit 20*b* of the control unit 20 detects when the cover goes from being closed to open when special paper 10 is not loaded based on the output values of the cover sensor 22 and paper detection sensor 17.

A motor driver 23 is connected to the control unit 20, and a conveyance motor 24 that turns the platen roller 14, and a cutter drive motor 25 that operates the movable knife of the cutter mechanism 18, are connected to the motor driver 23. The conveyance motor 24 and cutter drive motor 25 are both stepper motors. The control unit 20 causes the platen roller 14 to turn and convey the special paper 10 in the forward direction YJ2 or the reverse direction YJ4 by controlling the motor driver 23 to drive the conveyance motor 24. The control unit 20 also operates the movable knife and cuts the special paper 10 by controlling the motor driver 23 to drive the cutter drive motor 25. In this embodiment the platen roller 14 and mechanical parts for turning the platen roller 14 work together and function as a conveyance unit, and the cutter mechanism 18 and mechanical parts that drive the cutter mechanism 18 work together and function as a cutter unit.

A head driver 27 is connected to the control unit 20, and the thermal head 12 is connected to the head driver 27. The control unit 20 records images on the special paper 10 by controlling the head driver 27 to supply drive current to the heat elements of the thermal head 12 and form dots on the recording surface of the special paper 10.

The input unit 28 is connected to an operating switch disposed to the printer 1, detects operation of the operating switch, and outputs to the control unit 20.

The display unit 29 includes a display panel such as an LCD panel or LED, and displays information using the display panel or LED.

The storage unit 30 includes nonvolatile memory such as an EEPROM device, and nonvolatilely stores data rewritably. The interface 31 communicates with the host computer 5 according to a communication standard as controlled by the control unit 20.

The host computer 5 has a printer driver installed thereto, appropriately sends control commands to the printer 1 and controls the printer 1 through the function of the printer driver.

The special paper 10 is described next.

Figure 3:
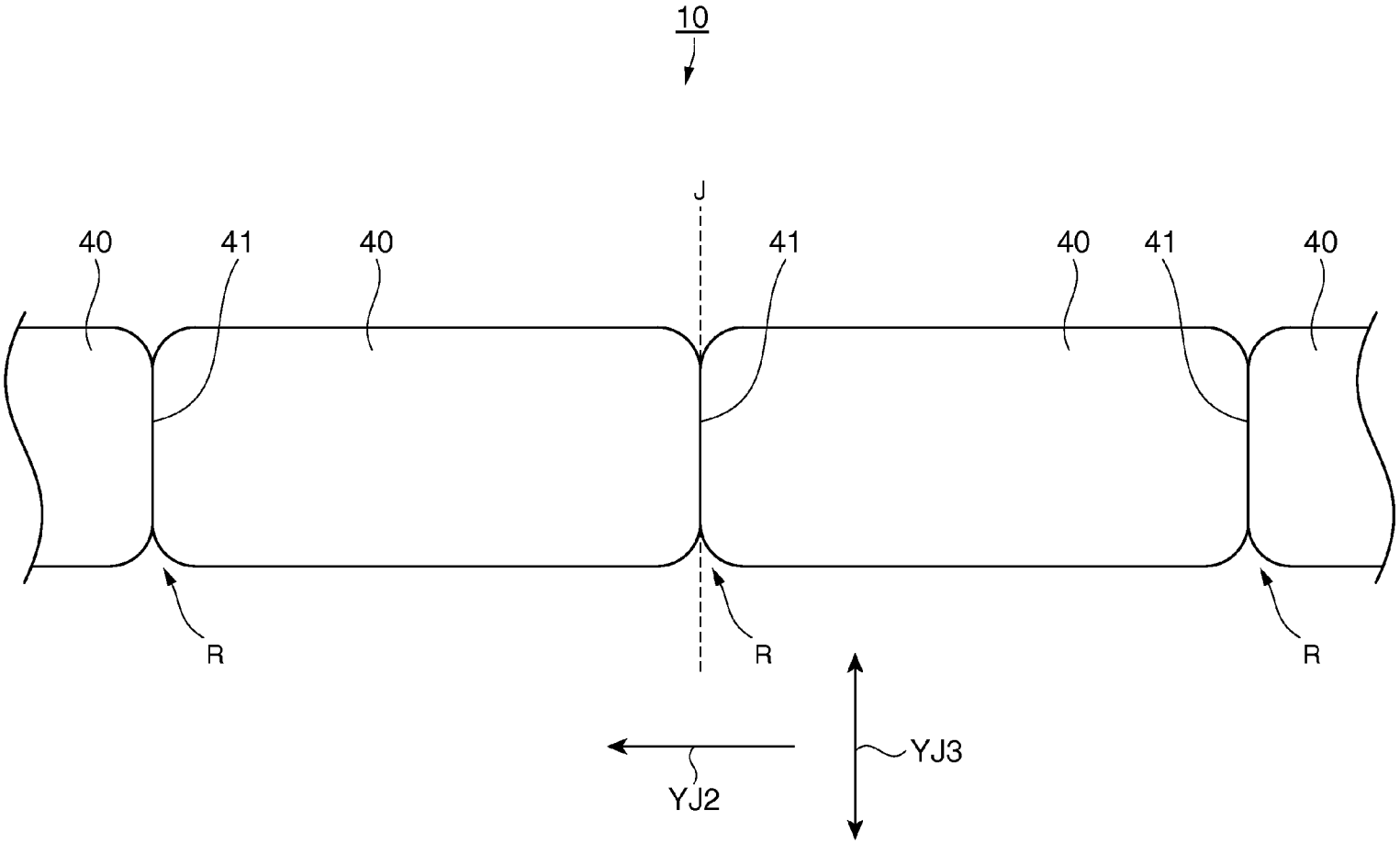
FIG. 3 shows an example of special paper.

FIG. 3 shows an example of special paper 10.

As shown in FIG. 3, the special paper 10 has a plurality of ticket blocks 40 connected at joints 41 into a continuous series. A ticket block 40 is a portion corresponding to a ticket to be produced, and to produce one ticket, a suitable image is recorded on one ticket block 40, and the one ticket block 40 is then cut off at the trailing joint 41. The produced tickets might be boarding passes printed on a specific floor of an airport, or event tickets printed at a particular store, for example.

The special paper 10 is loaded and conveyed through the printer 1 so that the long side of the special paper 10 corresponds to the conveyance direction YJ1, and the short side corresponds to the line direction YJ3.

As shown in FIG. 3, one ticket block 40 is basically rectangular when seen from the face, and the four corners are curved. The shape of the curve at each of the four corners is the same. Because the four corners of each ticket block 40 are curved, a notch R is formed at both ends in the line direction YJ3 of the joint 41 between each ticket block 40.

Because each notch R is formed by two identical corner curves, each notch R is line symmetrical to a virtual axis of symmetry J extending in the line direction YJ3 at the joint 41.

As described above, the printer 1 must cut the special paper 10 at a joint 41 (that is, at a position corresponding to the axis of symmetry J) in order to produce a ticket. More specifically, to produce a ticket the printer 1 must manage the position of the joints 41 in the special paper 10, and cut the special paper 10 with the cutter mechanism 18 when the appropriate joint 41 reaches the cutting position T3. Recording media having black marks formed at a constant interval in the conveyance direction YJ1 is therefore conventionally used, the black marks are optically detected with a dedicated sensor, and the cutting position of the recording medium is managed based on detection of the black marks.

In contrast, the printer 1 according to this embodiment of the invention uses characteristics of the shape of special paper 10 that does not have black marks to calculate and control the location of the joint 41 where special paper 10 is to be cut (positions corresponding to the axis of symmetry J).

The process whereby the cutting control unit 20*a* of the control unit 20 determines the position of the axis of symmetry J of any one notch R (the cutting position) based on the output of the notch detection sensor 19 is described next. The function of the cutting control unit 20*a* is achieved by the cooperation of hardware and software, such as the CPU of the control unit 20 reading and running firmware.

Figure 4:
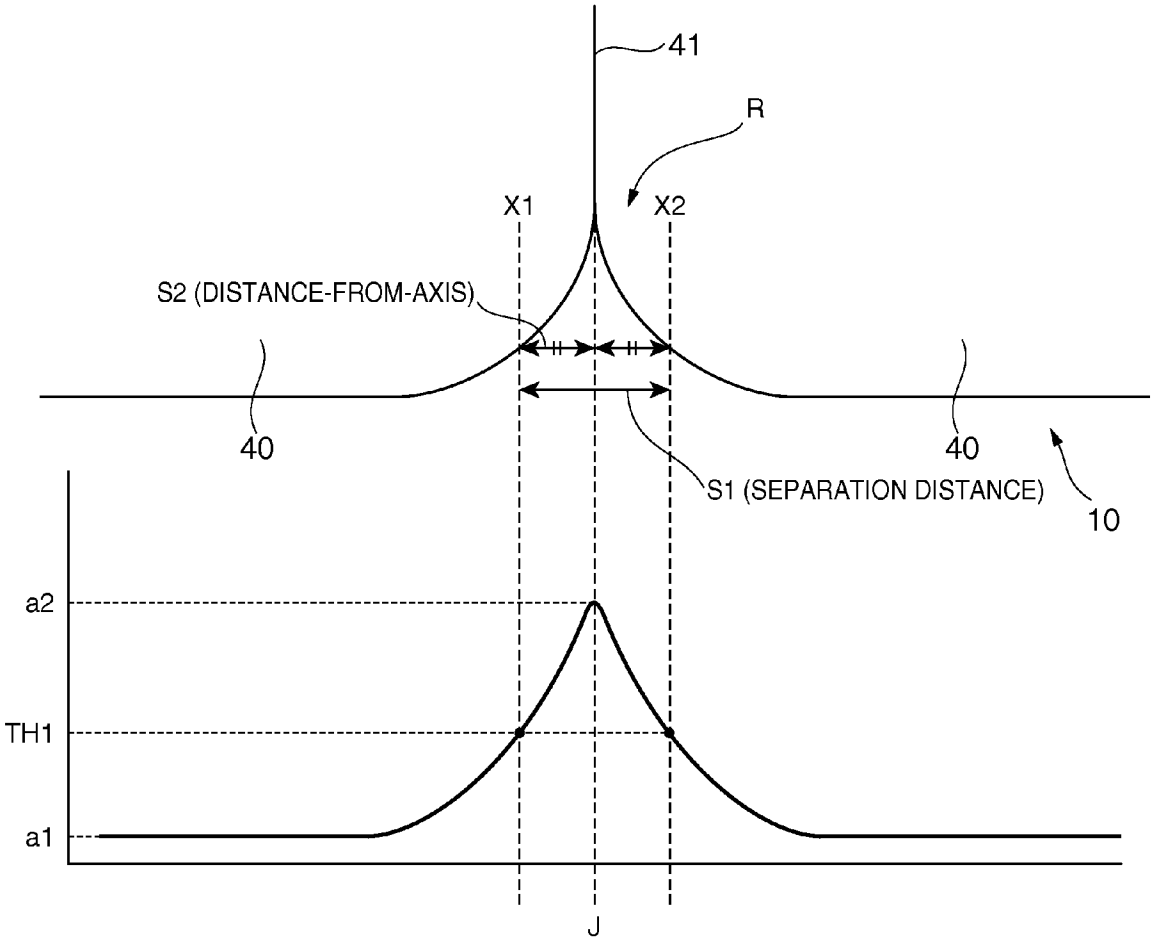
FIG. 4 shows the correlation between notches in the paper and the sensor output values at different positions in a notch.

FIG. 4 describes the correlation between the area where a notch R is formed in the special paper 10, and the output value of the notch detection sensor 19 when different parts of this area are located at the detection position T1. As described above, the notch detection sensor 19 is a transmissive sensor disposed to the detection position P1 where a notch R is formed on the left side of the special paper 10 in the forward conveyance direction YJ2. The output value of the notch detection sensor 19 therefore decreases as the area covered by the special paper 10 between the emitter and receptor of the notch detection sensor 19 increases. As shown on the bottom in FIG. 4, the output of the notch detection sensor 19 therefore changes according to the shape of the notch R as each part of the area where the notch R is formed in the special paper 10 reaches the detection position T1.

More specifically, as shown on the bottom in FIG. 4, in the area outside the notch R (the area outside the curved corners), the output value of the notch detection sensor 19 is a substantially constant value a1 because the special paper 10 occupies a constant space between the emitter and receptor of the notch detection sensor 19. However, in the area of the notch R (the area of the curved corners), the output wave of the notch detection sensor 19 is line symmetrical to the axis of symmetry J and peaks at the position corresponding to the axis of symmetry J (value a2).

As described below, the cutting control unit 20*a* can therefore use this characteristic to determine for anyone notch R the position of the one notch R to the axis of symmetry J.

More specifically, the cutting control unit 20*a* captures the output value of the notch detection sensor 19 while the special paper 10 is conveyed, and determines if the output value exceeds a predetermined threshold value TH1. This threshold value TH1 is a suitable value between the constant value a1 and the peak value a2, and in this embodiment is more specifically 65% of the output value of the notch detection sensor 19 when no recording medium is at the detection position T1. This threshold value TH1 is reset by the threshold setting unit 20*b* at a specific timing as further described below. The position of the special paper 10 when at the detection position T1 and the output value of the notch detection sensor 19 exceeds this threshold value TH1 is referred to below as the starting position (the position indicated by line segment X1 in FIG. 4).

When the output value of the notch detection sensor 19 exceeds the threshold value TH1, the cutting control unit 20*a* starts counting the steps turned by the conveyance motor 24, which is a stepper motor. In other words, the cutting control unit 20*a* starts counting the number of steps the conveyance motor 24 turns after the starting position X1 reaches the detection position T1. As known from the literature, the number of steps of the stepper motor is proportional to the conveyance distance of the special paper 10. Note that for brevity below, the unit of length is uniformly expressed as the number of steps turned by the conveyance motor 24. The length of one step equals the conveyance distance of the special paper 10 when the conveyance motor 24 is driven one step.

After the output value of the notch detection sensor 19 exceeds the threshold value TH1 and counting the steps the conveyance motor 24 turns starts, the cutting control unit 20*a* determines if the output value of the notch detection sensor 19 has gone below the threshold value TH1. The position of the special paper 10 when at the detection position T1 and the output value of the notch detection sensor 19 goes below this threshold value TH1 is referred to below as the end position (the position indicated by line segment X2 in FIG. 4).

When the output value of the notch detection sensor 19 goes below the threshold value TH1, the cutting control unit 20*a* stops counting the steps turned by the conveyance motor 24. The number of steps counted while the output value of the notch detection sensor 19 is greater than or equal to the threshold value TH1, that is, until the output value goes below the threshold value TH1 after exceeding the threshold value TH1, is the distance from the starting position X1 to the end position X2 (referred to below as the separation distance S1).

The cutting control unit 20*a* then calculates half the separation distance S1, and calculates the position separated a distance equal to this value (referred to below as the distance-from-axis S2) from the starting position X1 as the position of the axis of symmetry J of notch R.

This method enables appropriately calculating the position corresponding to the axis of symmetry J of the notch R. The reason for this is described below.

As described above, the curve is the same on all four corners of each ticket block 40, each notch R is therefore line symmetrical to the axis of symmetry J, and the waveform of the output of the notch detection sensor 19 in the area corresponding to the notch R has a shape that is line symmetrical to a virtual axis passing through the peak of the waveform and corresponding to the axis of symmetry J.

The distance between the axis of symmetry J and starting position X1, and the distance between the axis of symmetry J and end position X2, are therefore equal because the starting position X1 and end position X2 are the positions of the special paper 10 at the detection position T1 when the output value of the sensor respectively exceeds and then goes below a common threshold value TH1. The axis of symmetry J is therefore located at a position corresponding to the midpoint between the starting position X1 and end position X2, and the position corresponding to the axis of symmetry J can be appropriately determined by setting the position separated half (distance-from-axis S2) of the separation distance S1 (the distance between the starting position X1 and end position X2) as the position corresponding to the axis of symmetry J of the notch R.

In other words, the cutting control unit 20*a* according to this embodiment of the invention effectively uses a characteristic of the shape of the notch R, that is, that the shape of the notch R is line symmetrical to the axis of symmetry J, to determine the position (cutting position) appropriately corresponding to the axis of symmetry J based on the output value of the notch detection sensor 19.

Because the notch detection sensor 19 in this embodiment is a transmissive optical sensor, the position where the output value of the sensor exceeds the threshold value TH1 is used as starting position X1, and the position where the output value of the sensor goes below the threshold value TH1 is used as end position X2. However, if the notch detection sensor 19 is a reflective optical sensor, the waveform of sensor output over time will be the inverse of the shape shown on the bottom in FIG. 4, and the position where the output value of the sensor goes below the specific threshold value will be the starting position, and the position where the output value of the sensor exceeds the specific threshold value will be the end position.

The process of recording an image on the recording surface of the special paper 10 requires writing image data to the image buffer, controlling the motor driver 23 and head driver 27 based on the image data, and other related processes executed at the appropriate times, imposing a heavy load on the CPU. Allocating CPU time unnecessarily to other processes while executing the recording process is therefore preferably avoided. This is particularly important in a printer 1 because a low performance CPU is often used to meet demands for small size and low cost.

The printer 1 according to this embodiment of the invention meets these needs by executing the process described below when continuously producing tickets using special paper 10.

Figures 5A, 5B, 5C, 5D, 5E, 5F, 5G, 5H, 5I, 5J:
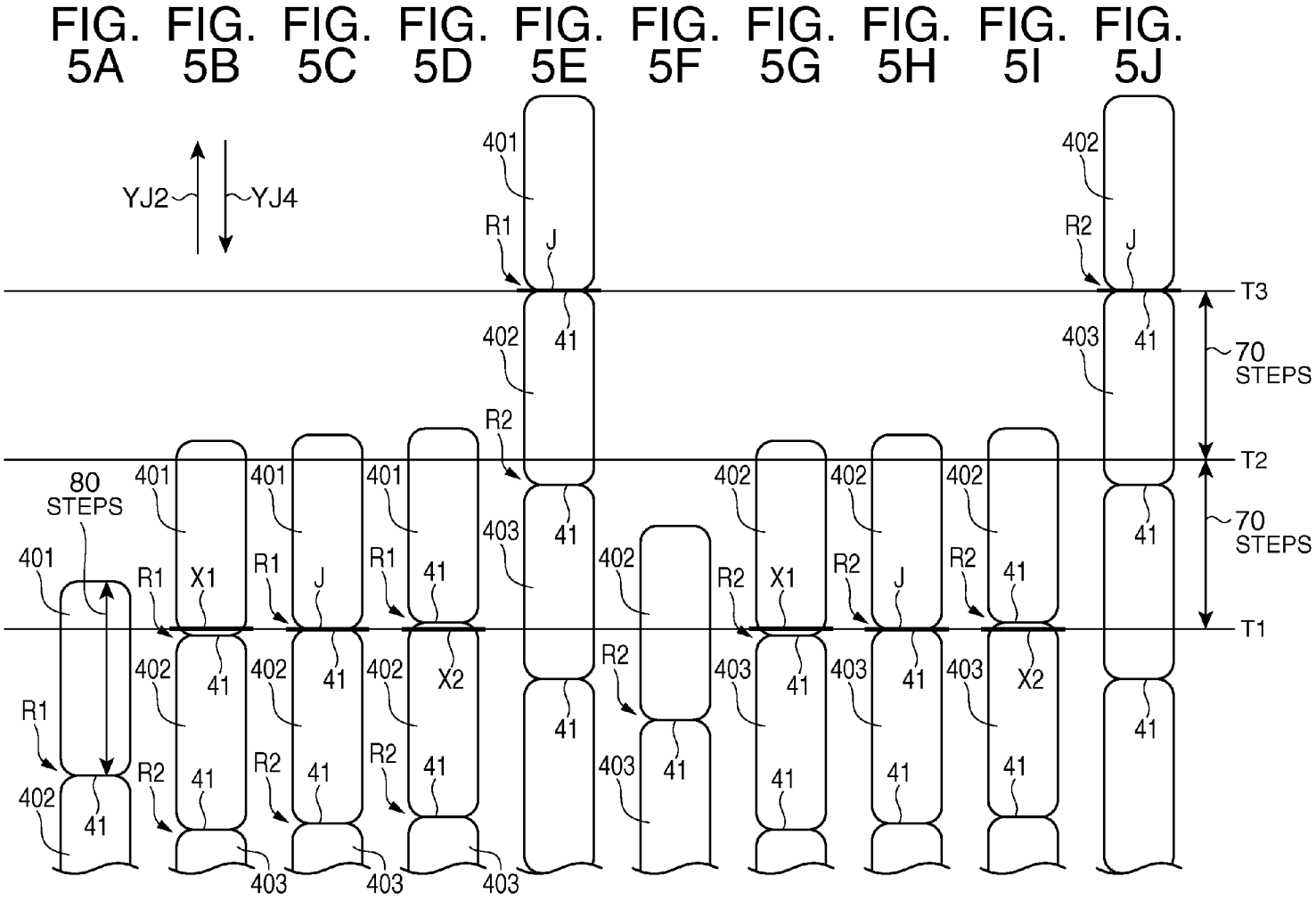
FIGS. 5A, 5B, 5C, 5D, 5E, 5F, 5G, 5H, 5I and 5J describe the operation of the printer.

FIG. 5 is used to describe an example of printer 1 operation when continuously producing tickets using this special paper 10. FIG. 5 shows the progress of this process from (A) to (J).

In the example shown in FIG. 5, the special paper 10 has a series of ticket blocks 401, 402, and 403 connected one after the other starting from ticket block 401, each corresponding to the ticket block 40 described above and used to produce a ticket. Notch R1 is formed between ticket block 401 and ticket block 402, and notch R2 is formed between ticket block 402 and ticket block 403. For brevity, the process of recording an image is not described in detail below.

In the following example, the length of one ticket block 40 in the conveyance direction YJ1 of the special paper 10 is 80 steps, the distance between the detection position T1 and the recording position T2 is 70 steps, and the distance between the recording position T2 and the cutting position T3 is 70 steps.

The cutting control unit 20*a* of the control unit 20 of the printer 1 first starts conveying the loaded special paper 10 in the forward direction YJ2 (FIG. 5 (A)). After conveyance starts, the cutting control unit 20*a* monitors the output of the notch detection sensor 19, and starts counting the steps turned by the conveyance motor 24 when the sensor output value surpasses the threshold value TH1 (when the starting position X1 of notch R1 reaches the detection position T1 as shown in FIG. 5 (B)). The number of steps counted is constantly saved to a start-end distance variable H1, which is a variable defined in firmware. The cutting control unit 20*a* then conveys the special paper 10 in the forward direction YJ2 the number of steps stored in a distance-from-axis variable H2, which is another variable defined in firmware, from when the sensor output value exceeds the threshold value TH1 (FIG. 5 (C)). As further described below, the value of the distance-from-axis S2 calculated from the starting position X1 and end position X2 of the notch R that last past the notch detection sensor 19 is stored to this distance-from-axis variable H2. When the first notch R passes the notch detection sensor 19, the value of the distance-from-axis S2 previously calculated from experiments or simulations or defined by the user is stored to the distance-from-axis variable H2 instead of the value of the distance-from-axis S2 calculated from the last notch R that past the notch detection sensor 19.

As described above, because the distance-from-axis S2 is the distance between the starting position X1 and the axis of symmetry J, the axis of symmetry J of the notch R1 (the cutting position at the joint 41 in the notch R1) will be set to the detection position T1 by conveying the special paper 10 distance-from-axis S2 in the forward direction YJ2 from when the sensor output value exceeds the threshold value TH1 (when the starting position X1 of the notch R1 reaches the detection position T1 as shown in FIG. 5 (B)).

After reaching the position shown in FIG. 5 (C) (where the axis of symmetry J of the notch R1 is at the detection position T1), the cutting control unit 20*a* starts counting the steps turned by the conveyance motor 24. For clarity, the number of steps turned by the conveyance motor 24 that is counted from when the axis of symmetry J reaches the detection position T1 is constantly saved to a cutting position control variable H3, which is a variable defined in firmware.

The distance between the detection position T1 and the cutting position T3 is 140 steps. Therefore, by conveying the special paper 10 140 steps in the forward direction YJ2 after the axis of symmetry J of the notch R1 reaches the detection position T1, the axis of symmetry J of the notch R1 (cutting position) reaches the cutting position T3, and cutting at the axis of symmetry J of the notch R1 (at the joint 41) is possible. The cutting control unit 20*a* controls the conveyance distance after the axis of symmetry J of the notch R1 reaches the detection position T1 using the cutting position control variable H3, and detects when the axis of symmetry J of the notch R1 has reached the cutting position T3 by detecting when the value stored in the cutting position control variable H3 reaches 140 steps. More specifically, because the axis of symmetry J (the cutting position where the special paper 10 should be cut) is located distance-from-axis S2 from the starting position X1, the cutting control unit 20*a* according to this embodiment of the invention manages the position of the axis of symmetry J referenced to when conveyance equal to the calculated distance-from-axis S2 is completed after the starting position X1 reached the detection position T1. As a result, the steps turned by the conveyance motor 24 after the axis of symmetry J reached the detection position T1 (equal to the value stored in the cutting position control variable H3), and the distance between the detection position T1 and the axis of symmetry J, are the same, the position of the axis of symmetry J (the cutting position where the special paper 10 should be cut) is easily managed, processing is efficient, and complicating the control program can be suppressed.

After the axis of symmetry J of the notch R1 reaches the detection position T1, the cutting control unit 20*a* gets the output value of the notch detection sensor 19, and when the sensor output value goes below the threshold value TH1 (when the end position X2 of the notch R1 reaches the detection position T1 as shown in FIG. 5 (D)), stops counting the number of steps counted since the sensor output value surpassed the threshold value TH1 (the number of steps managed using the start-end distance variable H1). The value stored in the start-end distance variable H1 at this time is the separation distance S1 between the starting position X1 and end position X2 of notch R1.

The cutting control unit 20*a* then continues conveying the special paper 10 in the forward direction YJ2, and pauses conveyance when the value stored in the cutting position control variable H3 reaches 140 steps (FIG. 5 (E)). As described above, that the value stored in the cutting position control variable H3 equals 140 steps means that the conveyance distance since the axis of symmetry J of the notch R1 reached the detection position T1 is 140 steps, and the axis of symmetry J of the notch R1 (cutting position) has reached the cutting position T3. As further described below, during conveyance from the position shown in FIG. 5 (B) to the position shown in FIG. 5 (E), an image is appropriately recorded on the recording surface of the ticket block 401 by the thermal head 12 as controlled by the control unit 20. As described above, the image recording process applies a heavy load on the CPU, and the CPU is preferably not diverted unnecessarily to other processes during the recording process.

After the axis of symmetry J of the notch R1 reaches the cutting position T3 (FIG. 5 (E)), the cutting control unit 20*a* controls the motor driver 23, drives the cutter drive motor 25 to operate the movable knife, and cuts the special paper 10 at the axis of symmetry J of the notch R1. This completes producing a ticket on ticket block 401.

While conveyance of the special paper 10 is stopped after cutting the special paper 10, the cutting control unit 20*a* calculates the distance-from-axis S2 based on the separation distance S1 in notch R1.

More specifically, the cutting control unit 20*a* retrieves the value stored in the start-end distance variable H1 (the separation distance S1 between the starting position X1 and end position X2 in notch R1). Next, the cutting control unit 20*a* calculates half the acquired separation distance S1 to get the distance-from-axis S2. Next, the cutting control unit 20*a* stores the calculated distance-from-axis S2 in the distance-from-axis variable H2. The cutting control unit 20*a* then clears the start-end distance variable H1 and cutting position control variable H3.

This embodiment thus executes the process of calculating the distance-from-axis S2 with the cutting control unit 20*a* and associated processes when image recording is finished, cutting the special paper 10 is completed, and the special paper 10 is not being conveyed. As a result, using the CPU to execute the distance-from-axis S2 calculation process can be effectively prevented when processes including the image recording process are executing and the CPU is preferably not diverted to other processes unnecessarily.

Note that "half" as used herein does not mean precisely ½, and may obviously reflect a margin calculated from prior tests or simulations.

After completing calculating the distance-from-axis S2 and storing the distance-from-axis S2 to the distance-from-axis variable H2, the cutting control unit 20*a* conveys the special paper 10 a specific distance in the reverse direction YJ4 (FIG. 5 (F)) so that recording an image on the next ticket block 402 can start.

Next, the cutting control unit 20*a* starts conveying the special paper 10 in the forward direction YJ2, monitors the output value of the notch detection sensor 19 after conveyance starts, and when the sensor output value exceeds the threshold value TH1 (when the starting position X1 of the notch R2 reaches the detection position T1 as shown in FIG. 5 (G)), starts counting the steps turned by the conveyance motor 24. The number of steps that is counted is constantly stored to the start-end distance variable H1.

The cutting control unit 20*a* then conveys the special paper 10 in the forward direction YJ2 the number of steps indicated by the value stored in the distance-from-axis variable H2 from when the sensor output value surpassed the threshold value TH1 (FIG. 5 (H)).

As described above, the distance-from-axis S2 calculated from the separation distance S1 of notch R1 is stored in the distance-from-axis variable H2. When calculating the axis of symmetry J of notch R2, the cutting control unit 20*a* uses the distance-from-axis S2 calculated based on the notch R1 that past the notch detection sensor 19 immediately before notch R2, and sets the position separated distance-from-axis S2 from the starting position X1 of notch R2 as the axis of symmetry J of the notch R2.

When the special paper 10 is conveyed in the printer 1, the paper may not be conveyed precisely as expected because of slight skewing of the special paper 10, the conveyance motor 24 being slightly out of step, individual differences between printers 1, or aging, for example. The optimum value of the distance-from-axis S2 therefore changes according to conveyance of the special paper 10. Therefore, by calculating the distance-from-axis S2 using the actually detected separation distance S1 instead of using a fixed value as the distance-from-axis S2, this embodiment suppresses deviation of the distance-from-axis S2 from the optimal value, and can maintain a value that is as accurate as possible.

More specifically, this embodiment uses the distance-from-axis S2 calculated from the last notch R that past the notch detection sensor 19 before any one notch R as the distance-from-axis S2 of that one notch R. The one notch R and the preceding notch R are close together, the conveyance state when the previous notch R past the notch detection sensor 19 and the conveyance state when the one notch R passes the notch detection sensor 19 are similar, and the likelihood that the distance-from-axis S2 calculated from the preceding notch R, and the distance-from-axis S2 that can be expected based on the one notch R, are close is extremely high. As a result, the axis of symmetry J of a notch R can be detected using an appropriate distance-from-axis S2 by using the distance-from-axis S2 calculated from the preceding notch R as the distance-from-axis S2 of the one next notch R as in this embodiment.

After the position shown in FIG. 5 (H) is reached (the axis of symmetry J of the notch R2 has reached the detection position T1), the cutting control unit 20*a* starts counting the steps turned by the conveyance motor 24, and constantly stores the counted number of steps in the cutting position control variable H3.

After the axis of symmetry J of the notch R2 has reached the detection position T1, the cutting control unit 20*a* monitors the output value of the notch detection sensor 19, and when the sensor output value goes below the threshold value TH1 (when the end position X2 of the notch R2 reaches the detection position T1 as shown in FIG. 5 (I)), stops counting the number of steps counted since the sensor output value surpassed the threshold value TH1 (the number of steps managed using the start-end distance variable H1). The value stored in the start-end distance variable H1 at this time is the separation distance S1 between the starting position X1 and end position X2 of notch R2.

The cutting control unit 20*a* then continues conveying the special paper 10 in the forward direction YJ2, and pauses conveyance when the value stored in the cutting position control variable H3 reaches 140 steps (FIG. 5 (J)). As described above, that the value stored in the cutting position control variable H3 equals 140 steps means that the conveyance distance since the axis of symmetry J of the notch R2 reached the detection position T1 is 140 steps, and the axis of symmetry J of the notch R2 has reached the cutting position T3.

Next, the cutting control unit 20*a* drives the cutter drive motor 25 and cuts the special paper 10 at the axis of symmetry J of the notch R2. This completes producing a ticket on ticket block 402.

While conveyance of the special paper 10 is stopped, the cutting control unit 20*a* calculates the distance-from-axis S2 based on the separation distance S1 in notch R2, and stores the value in the distance-from-axis variable H2. The distance-from-axis S2 stored in distance-from-axis variable H2 at this time is used to calculate the axis of symmetry J in the next notch R3.

The threshold setting unit 20*b* of the control unit 20 of the printer 1 is described next. The function of the threshold setting unit 20*b* is achieved by cooperation of hardware and software, such as a CPU of the control unit 20 reading and running a firmware.

Because the separation distance S1 is used to calculate the distance-from-axis S2, the threshold value TH1 must be a suitable, sufficient value. As a result, the threshold value TH1 in this embodiment is set to 65% of the notch detection sensor 19 output value when the recording medium is not at the detection position T1. However, because the output value of the notch detection sensor 19 may vary in the same environment due to aging of the sensor, soiling, or other reason, the value used as the threshold TH1 should change according to the actual output of the notch detection sensor 19.

The threshold setting unit 20*b* therefore executes the following process.

More specifically, the threshold setting unit 20*b* monitors the output of the cover sensor 22 and paper detection sensor 17 while the power is on. When the cover is detected to have changed from the closed to the open position based on the output values of these sensors when special paper 10 is not loaded, the threshold setting unit 20*b* acquires the output value of the notch detection sensor 19 and sets the threshold value TH1 to 65% of the acquired output value.

As a result of this process, the threshold value TH1 is always reset to an appropriate value based on the actual output value of the notch detection sensor 19 when special paper 10 is not loaded, the cover changes from closed to open, and a ticket is not expected to be produced for a period of time.

As described above, the printer 1 according to this embodiment of the invention has a conveyance unit (platen roller 14, conveyance motor 24, and related mechanisms) that conveys a special paper 10 in the conveyance direction YJ1 through a conveyance path 11; a thermal head 12 (recording unit) that records on the special paper 10 conveyed through the conveyance path 11; a cutter mechanism 18 (cutting unit) that cuts the special paper 10 conveyed through the conveyance path 11; and a notch detection sensor 19 disposed to a detection position T1 on the conveyance path 11 where a notch R formed in the special paper 10 passes. A cutting control unit 20*a* monitors the output value of the special paper 10 while the special paper 10 is conveyed, and calculates a position corresponding to the axis of symmetry J of the notch R where the special paper 10 should be cut based on a starting position X1, which is the position of the special paper 10 at the detection position T1 when the sensor output value goes above a threshold value TH1, and an end position X2, which is the position of the special paper 10 at the detection position T1 when the sensor output value goes below the threshold value TH1.

The printer 1 according to this embodiment of the invention can therefore appropriately calculate the position where the special paper 10 should be cut using a characteristic of the shape of the notch R instead of optically reading position detection marks, for example, because the output value of the notch detection sensor 19 is monitored and the starting position X1 and end position X2 of the notch R are detected while the special paper 10 is conveyed, and a position corresponding to the axis of symmetry J of the notch R is calculated based on the starting position X1 and end position X2.

The cutting control unit 20*a* in this embodiment of the invention calculates the position separated distance-from-axis S2 from the starting position X1 as the position corresponding to the axis of symmetry J of the notch R, where distance-from-axis S2 corresponds to half the separation distance S1, and separation distance S1 is the distance between the starting position X1 and end position X2.

Because the shape of the notch R is line symmetrical to the axis of symmetry J, the waveform of notch detection sensor 19 output after the starting position X1 reaches the detection position T1 until the end position X2 reaches the detection position T1 peaks at the midpoint between the output at starting position X1 and the output at end position X2. The position of the special paper 10 at this peak is the position corresponding to the axis of symmetry J of the notch R. As a result, by calculating the position separated distance-from-axis S2, which is a distance corresponding to half the distance between the starting position X1 and end position X2, from the starting position X1 as the position corresponding to the axis of symmetry J of the notch R, a characteristic of the shape of the notch R can be used to appropriately calculate the position where the special paper 10 should be cut.

After calculating the distance-from-axis S2 based on the starting position X1 and end position X2 for one notch R, the cutting control unit 20*a* in this embodiment also calculates the position corresponding to the axis of symmetry J of the next notch R to the pass the detection position T1 after the one notch R by calculating the position separated the distance-from-axis S2 that was calculated based on the one notch from the starting position X1 of the next notch R.

Because the printer 1 in this embodiment calculates the position corresponding to the axis of symmetry J of the next notch R by using the distance-from-axis S2 calculated from the starting position X1 and end position X2 of the one notch, the position of the special paper 10 can be adjusted referenced to the position corresponding to the axis of symmetry J of the next notch R (the position to be cut) reaching the detection position T1, and complicating the process can be suppressed.

After the one notch passes the detection position T1 and before the next notch passes the detection position T1 when not recording on the special paper 10 with the thermal head 12, the cutting control unit 20*a* in this embodiment also calculates the distance-from-axis S2 based on the starting position X1 and end position X2 of the one notch.

Because the printer 1 thus comprised calculates the distance-from-axis S2 based on the starting position X1 and end position X2 of the one notch after the one notch passes the detection position T1 and before the next notch passes the detection position T1 when not recording on the special paper 10 with the thermal head 12, allocating CPU time to the process of calculating the distance-from-axis S2 while the CPU is being used for the process of recording on the special paper 10 is suppressed, and the need to not use the CPU for other tasks while executing the recording process can be appropriately met.

The threshold setting unit 20*b* in this embodiment sets the threshold value TH1 based on notch detection sensor 19 output when the special paper 10 is not loaded.

While the output of the notch detection sensor 19 may change due to aging of the sensor, soiling, or other reason, this configuration dynamically sets the threshold value TH1 according to the actual sensor output, and can therefore desirably set the threshold value TH1 based on the actual state of the sensor.

This embodiment of the invention is simply one possible embodiment, and can obviously be changed and adapted in many ways without departing from the scope of the accompanying claims.

For example, the foregoing embodiment uses as the distance-from-axis S2 for any one notch R the distance-from-axis S2 that was calculated based on the last notch R that passed the notch detection sensor 19 before the one notch R. However, the value calculated from the separation distance S1 of the one notch R can obviously be used as the distance-from-axis S2 of that one notch R. This method complicates processing and increases the processing load on the CPU compared with the embodiment described above, and is therefore suited to configurations having a powerful CPU.

The printer 1 in the foregoing embodiment is a thermal printer, but the printing method of the printer 1 is not limited to thermal printing, and an inkjet, dot impact, or other printing method can be used. More specifically, the invention can be broadly applied to recording devices that must cut recording media having notches that are shaped line symmetrically to an axis of symmetry at a position corresponding to the axis of symmetry of the notch.

The function blocks shown in FIG. 2 can be achieved in many ways through the cooperation of software and hardware, and do not suggest a specific hardware configuration. The functions of individual function blocks of the printer 1 can also be offloaded to a separate device externally connected to the printer 1. The printer 1 can also execute the operations described above by running a program stored on an externally connected storage medium. This program can be provided stored on a storage medium such as a hard disk, optical disc, magneto-optical disc, or flash memory.

What is claimed is:

1. A recording device comprising:

a conveyance unit configured to convey a recording medium a controlled distance through a conveyance path, said recording medium having at least one notch;

a recording unit configured to record on the recording medium;

a cutting unit configured to cut the recording medium, said cutting unit being at a known location along the conveyance path;

a sensor configured to sense a varying amount of recording medium within a defined sensing region, wherein the magnitudes of the output signals from the sensor are proportional to the amount of sensed recording medium within said sensing region, said sensing region being a known distance from the cutting unit along the conveyance path, and being positioned to coincide at least partially with the conveyance path of the notch as the medium is conveyed; and a control unit configured to:

(a) control the conveyance unit, the recording unit, and the cutting unit;

(b) acquire output signals from the sensor while conveying the recording medium with the conveyance unit;

(c) determine a length-span of the notch based on the magnitudes of the output signals issued by the sensor as the notch is conveyed pass the sensing region, wherein as the notch enters, passes through, and exits the sensing region, the magnitudes of the output signals respectively vary gradually from an initial magnitude, to a peak magnitude and return to the initial magnitude, said length-span being a dimension of the notch along the conveyance path;

(c) identify a target cutting position within the length-span of the notch, and determine a conveyance distance from the target cutting position to the cutting unit based on the location of the target cutting position relative to the known position of the cutting unit along the conveyance path; and (d) convey the notch to the cutting unit and cut the recording medium with the cutting unit at the target cutting position based on the determined conveyance distance.

2. The recording device described in claim 1, wherein:

the control unit is further configured to identify a distance from an upstream edge of the one notch to the target cutting position within the length-span of the one notch as a distance-from-axis offset;

said recording medium has a plurality of said notches arrange in a series along its length, the length of the recording medium being a dimension of the recording medium along the conveyance path; and a second target cutting position for a second notch subsequent to the one notch coincides substantially as the distance-from-axis offset from an upstream edge of the second notch.

3. The recording device of claim 1, wherein substantially the midpoint between the length-span of the notch is identified as said target cutting position.

4. The recording device of claim 1, wherein a location substantially coinciding with the peak magnitude of output signals is selected as said target cutting position.

5. The recording device of claim 1, wherein said notch has line symmetry along an axis line perpendicular to the conveyance path at the location of the sensing region, and the location of the axis line is selected as said target cutting position.

6. The recording device of claim 1, wherein the magnitude of the output signals from the sensor is proportional to an amount of area of the sensing region that is covered by the recording medium.

7. The recording device of claim 1, wherein as the magnitudes of the output signals vary from their initial value toward their peak value, a first location substantially coinciding with a first output signal that meets a first threshold magnitude is noted, and as the magnitudes of the output signals returns from their peak value back to their initial magnitude, a second location substantially coinciding with a second output signal that meets a second threshold is noted, and the distance between the first location and the second location is deemed said length-span of the notch.

8. The recording device of claim 7, wherein said first threshold and second threshold are set substantially to 65% of a magnitude of an output signal issued from the sensor when no recording medium is within any part of the sensing region.

9. The recording device of claim 1, wherein said recording medium has a plurality of said at least one notch arrange in a series along its length.

10. The recording device of claim 9, wherein said series of notches are located along an edge of the recording medium.

11. The recording device of claim 10, wherein said recording medium is comprised of a series of ticket blocks coupled end-to-end, each ticket block having substantially rounded corners, and each pair of facing rounded corners from two consecutive ticket blocks form a corresponding one of said notches.

12. The recording device of claim 11, wherein said ticket blocks have no notches within their interior area.

13. A control method of a recording device that has a conveyance unit that conveys a recording medium through a conveyance path, said recording medium having at least one notch, a recording unit that records on the recording medium, a cutting unit that cuts the recording medium, said cutting unit being at a known location along the conveyance path, and a sensor that detects a varying amount of recording medium within a defined sensing region, wherein the magnitudes of the output signals from the sensor are proportional to the varying amount of sensed recording medium within said sensing region, said sensing region being a known distance from the cutting unit along the conveyance path, and being positioned to coincide at least partially with the conveyance path of the notch as the medium is conveyed, the control method comprising:

acquiring output signals from the sensor while conveying the recording medium with the conveyance unit;

determining a length-span of the notch based on the magnitudes of the output signals issued by the sensor as the notch is conveyed pass the sensing region, wherein as the notch enters, passes though, and exits sensing region, the magnitudes of the output signals respectively vary gradually from an initial magnitude, to a peak magnitude and return to the initial magnitude, said length-span being a dimension of the notch along the conveyance path;

identifying a target cutting position within the length-span of the notch, and determining a conveyance distance from the target cutting position to the cutting unit based on the location of the target cutting position relative to the known position of the cutting unit along the conveyance path; and convey the notch to the cutting unit and cutting the recording medium with the cutting unit at the target cutting position based on the determined conveyance distance.

14. The control method of a recording device described in claim 13, further comprising:

identify a distance from an upstream edge of the one notch to the target cutting position within the length-span of the one notch as a distance-from-axis offset;

wherein:

said recording medium has a plurality of said notches arrange in a series along its length, the length of the recording medium being a dimension of the recording medium along the conveyance path; and a second target cutting position for a second notch subsequent to the one notch coincides substantially as the distance-from-axis offset from an upstream edge of the second notch.

15. The control method of claim 13, wherein:

said recording medium has a plurality of said at least one notch arrange in a series along its length;

said series of notches are located along an edge of the recording medium;

said recording medium is comprised of a series of ticket blocks coupled end-to-end, each ticket block having substantially rounded corners, and each pair of facing rounded corners from two consecutive ticket blocks form a corresponding one of said notches; and said ticket blocks have no notches within their interior area.

16. The control method of claim 13, wherein:

the magnitudes of the output signals from the sensor are proportional to an amount of sensed recording medium within said sensing region;

as the notch enters, passes through, and exits the sensing region, the magnitudes of the output signals respectively vary from an initial magnitude, to a peak magnitude and return to the initial magnitude;

as the magnitudes of the output signals vary from their initial value toward their peak value, a first location substantially coinciding with a first output signal that first meets a first threshold magnitude is noted, and as the magnitudes of the output signals returns from their peak value back to their initial magnitude, a second location substantially coinciding with a second output signal that first meets a second threshold is noted, and the distance between the first location and the second location is deemed said length-span of the notch; and said first threshold and second threshold are set substantially to 65% of a magnitude of an output signal issued from the sensor when no recording medium is within any part of the sensing region.

17. control method of claim 13, wherein said notch has line symmetry along an axis line perpendicular to the conveyance path at the location of the sensing region, and the location of the axis line is selected as said target cutting position.

18. A non-transitory computer-readable storage medium storing a program executable by a control unit of the recording medium, and causes the control unit to execute the control method of claim 13.

* * * * *